United States Patent [19]

Müller

[11] 4,028,900

[45] June 14, 1977

[54] PILE WITH A FOOT

[76] Inventor: Günther Müller, 3550 Marburg, L-Wehrda, Germany

[22] Filed: Feb. 24, 1976

[21] Appl. No.: 660,984

[30] Foreign Application Priority Data

Feb. 24, 1975 Germany ..... 2507903

[52] U.S. Cl. ..... 61/53; 61/53.68; 175/19; 175/22

[51] Int. Cl.[2] ..... E02D 5/54

[58] Field of Search ..... 61/53, 53.5, 53.68, 61/58; 175/19, 21, 22; 52/170

[56] References Cited

UNITED STATES PATENTS 878,141 2/1908 Jackson ..... 61/53

FOREIGN PATENTS OR APPLICATIONS 3,723 2/1911 United Kingdom ..... 61/53

*Primary Examiner*—Jacob Shapiro

*Attorney, Agent, or Firm*—Hane, Sullivan & Spiecens

[57] ABSTRACT

A piling pole, comprising a piling pole for driving into the ground and having a shoe or foot provided with a displacement member, wherein the displacement member is formed by a plurality of parts, for example by two parts and both parts are disposed opposite one another and laterally spaced with respect to the axis of the piling shaft and are interconnected.

8 Claims, 5 Drawing Figures

PILE WITH A FOOT

This invention relates to a piling pole, comprising a piling shaft and a piling shoe with a displacement member. Obliquely driven anchor pilings for the rearward anchoring of a sheet piling in the ground are connected directly to the cut-off wall, either immediately above the concrete spar at the head, or at the wave trough of a sheet piling.

In case the piling is connected at the wave trough of a sheet piling a cut-out must be provided in the sheet piling for inserting and driving in the piles. In case the piles are provided with a welded-on piling shoe, the cut-out to be provided in the sheet piling depends upon the size of the piling shoe.

In order to keep the cut-out as small as possible, pilings are used into which piling shoes are screwed on in a manner known per se. This permits an initial pushing of the piling shoe by itself through the cut-out and its seccessive screwing in behind the cut-off wall.

According to a known embodiment, the piling shoe is axially screwed onto the piling shaft or pole from below. If the piling shaft is made of sectional steel, for example from two sections welded together so as to form a case by two U-shaped profiles or one I-shaped profile, the lower end of the piling pole is provided with a welded on round member bearing a screw thread. Onto such a round member the piling shoe provided with a concentric guide sleeve is placed and axially secured with the aid of a screw connection.

This known embodiment has the drawback that the axial screwing on of the piling shoe to the piling shaft in axial direction of the piling requires a relatively large free space for working behind the sheet piling.

Furthermore, the piling shoe is relatively heavy. Therefore, working in the often cramped space behind the sheet piling, in order to affix the piling shoe, is difficult.

In a piling with a piling shoe screwed on in the aforedescribed fashion the resistance of the piling shoe to penetration is substantially greater, because the wedge shape of the piling shoe must be at its joint with the round member be provided with a face plate so that the nut for fastening the piling shoe is furnished with an abutment.

Accordingly, the invention has the object to provide a piling pole, comprising a piling shaft and a piling shoe with a displacement member is such a fashion that its resistance to penetration is reduced, that its handling behind the sheet piling is facilitated and that a substantially smaller working space behind the sheet piling is required.

This object of the invention is obtained in that the displacement member is composed of a plurality of components including two parts, for example which both are disposed opposite one another and lateral to the axis of the piling shaft and in that these parts are interconnected.

Each part is inserted into a cut-out of the piling shaft and, advantageously, has wedge shaped surfaces which are in contact with the ground when the shaft is driven into the ground.

According to an embodiment by way of a example, each part is inserted into a cut-out in the cross arms of the piling shaft having the configuration of a double T-support.

Moreover, each part is provided with displacement sheets enclosing the piling shaft.

The flanges or crossbars of the piling shaft having the configuration of a double-T support extend below the wedge shaped parts and these flanges are interconnected by means of connecting sheets so that an all-around piling shoe is formed.

This arrangement permits the construction of parts of substantially lower weight now available from which makes attachment thereof to the piling shaft easier than heretofore possible by using piling shoes which required screwing on.

This arrangement also requires a substantially smaller working space behind the sheet piling. Moreover, the arranging of parts in cut-outs in the piling shaft results in a secure connection of the displacement member and the piling shaft. In addition, this arrangement of the piling shoe and of the displacement member substantially reduces the resistance to penetration than is possible in a piling with a screwed-on piling shoe, because all of the surfaces to be placed in contact with the ground extend either perpendicular or slanted.

Furthermore, it is advantageous that by this kind of configuration of the piling, the driving forces are directly passed on to the piling shoe, because the lower portion of the piling shaft has the configuration of a piling shoe.

The drawing illustrates an embodiment by way of example.

FIG. 5 is an exploded perspective view of the pile shoe assembly shown in FIGS. 1 to 4 on an enlarged scale.

Figure 1:
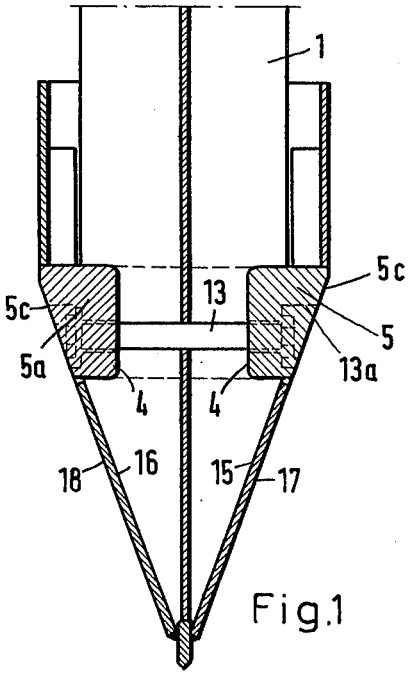
FIG. 1 shows a cross-section of a piling shoe according to the invention with a displacement member along lines I — I.
Figure 2:
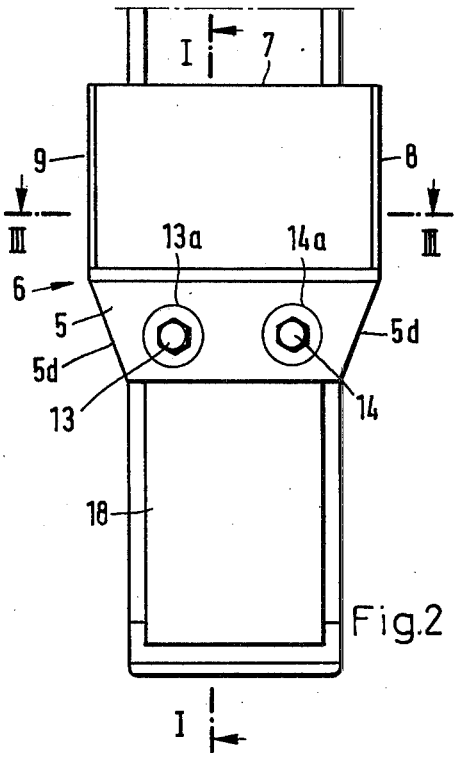
FIG. 2 shows a lateral elevation.

According to the embodiment by way of example, the piling shaft 1 comprises a double-T support being known per se, having flanges or cross bars 2 and 3. The flanges 2 and 3 are provided with cut-outs 4 disposed opposite one another with respect to the piling shaft axis 1*a*, into which cut-outs a part 5 and 5*a*, respectively of the displacement member 6 (FIG. 2) is inserted. This displacement member protrudes slightly beyond either side of the piling shaft.

Each part 5 and 5*a* is provided with displacement sheets 7, 8 and 9 which enclose the piling shaft 1 spaced therefrom so that when the piling pole is driven in, a hollow space is shaped about the piling shaft.

To permit the displacement sheets on the piling shaft in the form of a double-T-support to be supported, there are provided on their inside supporting lugs 10, 11 and 12.

The attachemnt of the parts 5 and 5*a* disposed laterally on the piling shaft is carried out with the aid of bolt connections 13 and 14.

Figure 4:
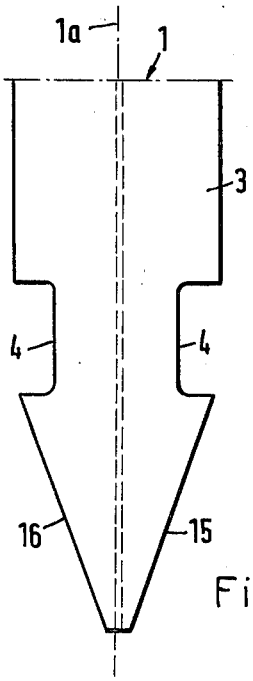
FIG. 4 shows from below the lower portion of the piling shaft without the displacement member.
Figure 3:
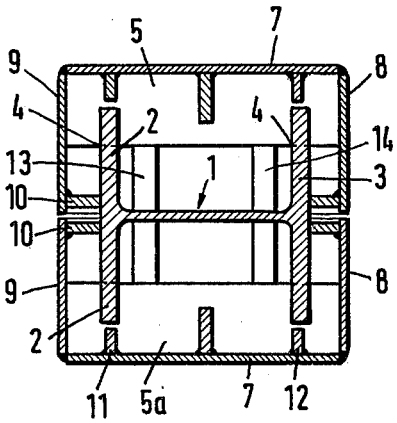
FIG. 3 shows a cross-section along lines III — III.

Below the parts 5 and 5*a*, the flanges 2 and 3 of the piling shaft having the configuration of a double-T-support have wedge shaped flange portions thus formed 15, 16 (FIG. 4).

In order to give the piling shoe thus formed a wedge-shape in this area, the slanted flanges 15, 16 are interconnected by connecting sheets 17, 18.

Parts 5 and 5*a* are conically shaped at their outer surfaces 5*c*, 5*d* which are to be in contact with the ground when the shaft is driven in the area of the connecting sheets 17, 18 are correlated with the slant of the wedge shaped piling shoe so that the resistance to penetration is reduced.

In order to assure that the heads of the bolt connection 13, 14 do not protrude so that no additional resistance is caused, the nuts are placed in recesses 13*a*, 14*a* in parts 5, 5*a*.

The oblique surfaces 5*d* of the parts 5, 5*a* may be interconnected by sheets so that for this area of the displacement member, a wedge shape configuration is also achieved.

Figure 5:
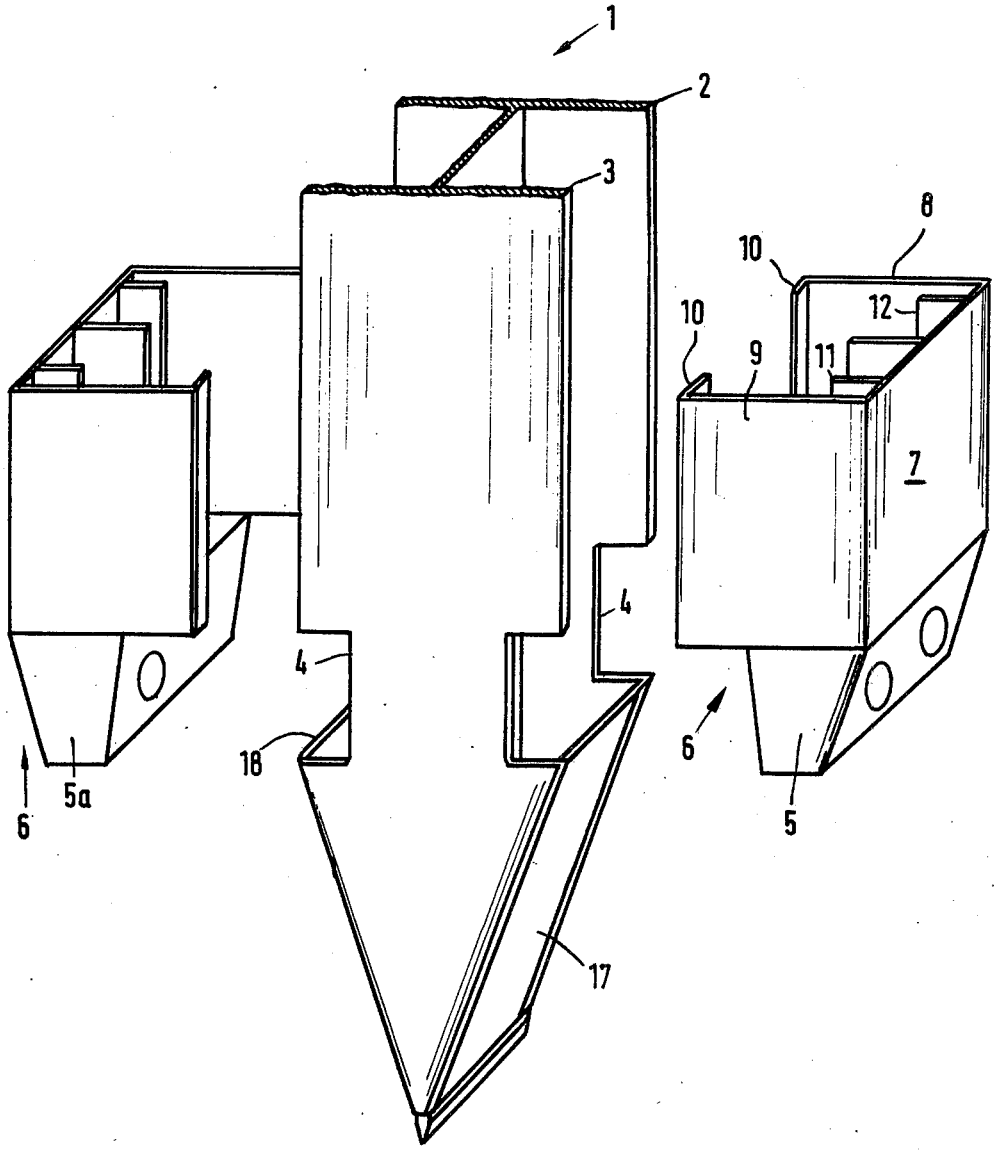
FIG. 5 is a perspective exploded view of the pile and foot as shown in FIGS. 1 to 4 on an enlarged scale.

FIG. 5 shows the same pile structures as shown in FIGS. 1 to 4 but exploded and enlarged. The same components are designated by the same reference numerals. The FIG. is self-explanatory on the basis of the preceding descriptions.

FIG. 5 show the heretofore described components of the pile shoe assembly in exploded perspective view, the reference numerals in FIG. 5 are the same as used in FIGS. 1 to 4 for the corresponding components.

What is claimed is:

1. A piling pole for driving into the ground, said piling pole comprising in combination:

an elongate pole terminating at its end to be driven into the ground in a generally wedge-shaped portion; displacement means for laterally displacing ground penetrated upon driving of the pole, said displacement means including at least two parts complementarily shaped and surrounding the pole radially spaced apart therefrom and to be parallel to the lateral surfaces of said wedge-shaped end of the pole; mounting means connecting said displacement parts and securing the same to the pole adjacent to the wedge-shaped end thereof, said mounting means including oppositely disposed cut-outs in the pole adjacent to the wedge-shaped end thereof; and protrustions on said parts inserted into said cut-outs and retained therein.

2. The piling pole according to claim 1 wherein headed bolt means lock said protrusions in said cut-outs, and wherein said parts have countersinks accommodating therein the heads of the bolt means thereby making the bolt means flush with the outside surfaces of the parts.

3. The piling pole according to claim 1 wherein said pole is a double-T beam, said cut-outs being provided in each of the cross arms of said beam.

4. The piling pole according to claim 1 wherein said outside surface portions on each of said displacement parts, which are in contact with the ground upon driving of the pole, are slanted toward said wedge-shaped pole end.

5. The piling pole according to claim 1 wherein each of said ground displacing parts comprises sheet metal plates surrounding said pole.

6. The piling pole according to claim 5 and comprising struts abutting against the pole and said sheet plates for supporting the latter.

7. The piling pole according to claim 1 wherein said pole is a double-T beam and the cross arms of the beam are slanted toward the driving end of the beam, thereby forming said wedge-shaped pole end, and wherein connecting sheets join said cross arms adjacent to said end.

8. A piling pole for driving into the ground, said piling pole comprising in combination;

an elongate pole terminating at its end to be driven into the ground in a generally wedge-shaped portion; displacement means for laterally displacing ground penetrated upon driving of the pole, said displacement means including at least two parts complementarily shaped and surrounding the pole radially spaced apart therefrom and to be parallel to the lateral surfaces of said wedge-shaped end of the pole, the maximal peripheral outline of the displacement means protruding laterally from the peripheral outline of the pole thereby forming a hollow space about the length of the pole as the same is driven into the ground; and mounting means connecting said displacement parts and securing the same to the pole adjacent to the wedge-shaped end thereof.

* * * * *